US005413342A

United States Patent [19]

Kaplan

[11] Patent Number: 5,413,342

[45] Date of Patent: May 9, 1995

[54] PYRAMID SLOT MACHINE

[76] Inventor: Edward B. Kaplan, 45 S. New York Rd., #202-A Suite. #200, Absecon, N.J. 08201

[21] Appl. No.: 147,576

[22] Filed: Nov. 5, 1993

[51] Int. Cl.[6] ..... A63F 5/04
[52] U.S. Cl. ..... 273/143 B
[58] Field of Search ..... 273/138 R, 138 A, 139, 273/143 B

[56] References Cited

U.S. PATENT DOCUMENTS 4,198,052 4/1980 Causelmann ..... 273/143 R
4,363,486 12/1982 Chaudhry et al. ..... 273/143 B
5,108,349 4/1992 Yamamoto ..... 273/143 B X

FOREIGN PATENT DOCUMENTS 2130413 5/1984 United Kingdom ..... 273/143 B

*Primary Examiner*—William H. Grieb
*Attorney, Agent, or Firm*—Edwin E. Greigg; Ronald E. Greigg

[57] ABSTRACT

The present invention comprises a plurality of stationary mounted rotating drums and opposite end drums being driven by a stepper motor that will work in conjunction with each other. An elongated belt having graphic patterns printed upon it is connected around each of these drums. The stepper motor will stop at a precise moment to display particular graphic symbols at any given time by a microprocessor. The window in which the symbols are displayed is in a triangular form with one window at the top, two windows in the middle and three windows at the bottom.

16 Claims, 8 Drawing Sheets

THREE LINER

BUY PAY

TOP

LEFT

RIGHT

JACKPOT FOR BOTH

PYRAMID SLOT MACHINE

BACKGROUND OF INVENTION

This invention relates to a slot machine with three or more moving elongated reels which are parallel with each other in a horizontal position that stop at arbitrary times. Upon these reels are several kinds of graphic patterns which will depict wins by number of matched patterns. A housing encloses the reels with a viewing window in front thereof through which the graphic patterns will be displayed. The front glass display will consist of display windows that are in the shape of a triangle and each triangle will be placed accordingly to form a larger triangle. This is where the idea of a PYRAMID comes from.

Heretofore slot machines of different design have been set forth in the prior art such as U.S. Pat. Nos. 4,198,052, 4,363,486 and 5,108,349. These patents differ from the present invention in several respects.

SUMMARY OF THE INVENTION

Reel-drum mechanisms that are on the market today are bulky and have a large amount of moveable parts that can break down. If one reel-drum becomes damaged, it is a long and tedious process to repair. The process of repairing a prior art reel-drum mechanism is as follows; the technician must take the whole reel mechanism out of the slot machine and set it down on a movable work bench to test each reel or return to the shop for repair. If any one reel is bad, the whole unit of three reels must be replaced with another to get the slot machine up and running as soon as possible. Then the large reel-drum mechanism must be pushed back to the work shop for repairs.

The basic idea is to take an existing slot machine and modify the glass display and the reel mechanism along with the pay out routine. The pay out will vary a little, but the concept is the same. The display window will be in the shape of a triangle or a pyramid, with six smaller pyramid windows inside. These windows will display the symbols accordingly. The machine can be a three liner game or a buy pay game, this will be explained later. This design can also be used in a video machine game. When using the video mode concept, only the programming needs to be changed for the pay out and graphics. When used as a slot machine mechanism, the reels will be elongated with a fabric tape or similar type of tape with the symbols imprinted upon the tape. The symbols will be optically read by either bar code or counted by a microprocessor or any other appropriate design. The three reels will be placed one above each other in horizontal positions and correlate with the display window. One side of each reel wheel will be mounted on a spin swivel shaft and drum. The other end of the reel mechanism will have a stepper motor for the spinning action.

With this new style of reel mechanism it is easier to repair and replace. The three horizontal reel mechanisms will be mounted independently of each other as separate units, and will have latches at one end, which will hold the stepper motor in place and swivel locks at the other end will hold the drum in place. If a reel mechanism goes bad, the technician will snap out only one reel and replace it with another. Another advantage to the single reel repair is the difference in weight. The single reel will only weight about one tenth of a standard reel mechanism.

It is therefore an object of the invention to provide a slot machine in which the reels with data thereon are mounted in a horizontal arrangement with the display data displayed in a pyramid form. The upper reel shows one symbol, the middle reel shows two symbols, and the bottom reel shows three symbols.

Another object is to provide a slot machine in which the reels are separate and can be removed separately for repairs.

A further object is to provide a slot machine with three parallel reels in which each of the reels are interchangeable with each other. Therefore it does not matter which reel goes in which location.

other objects and advantages will become obvious from the drawings set forth herein:

DETAILED DESCRIPTION

Figure 1:
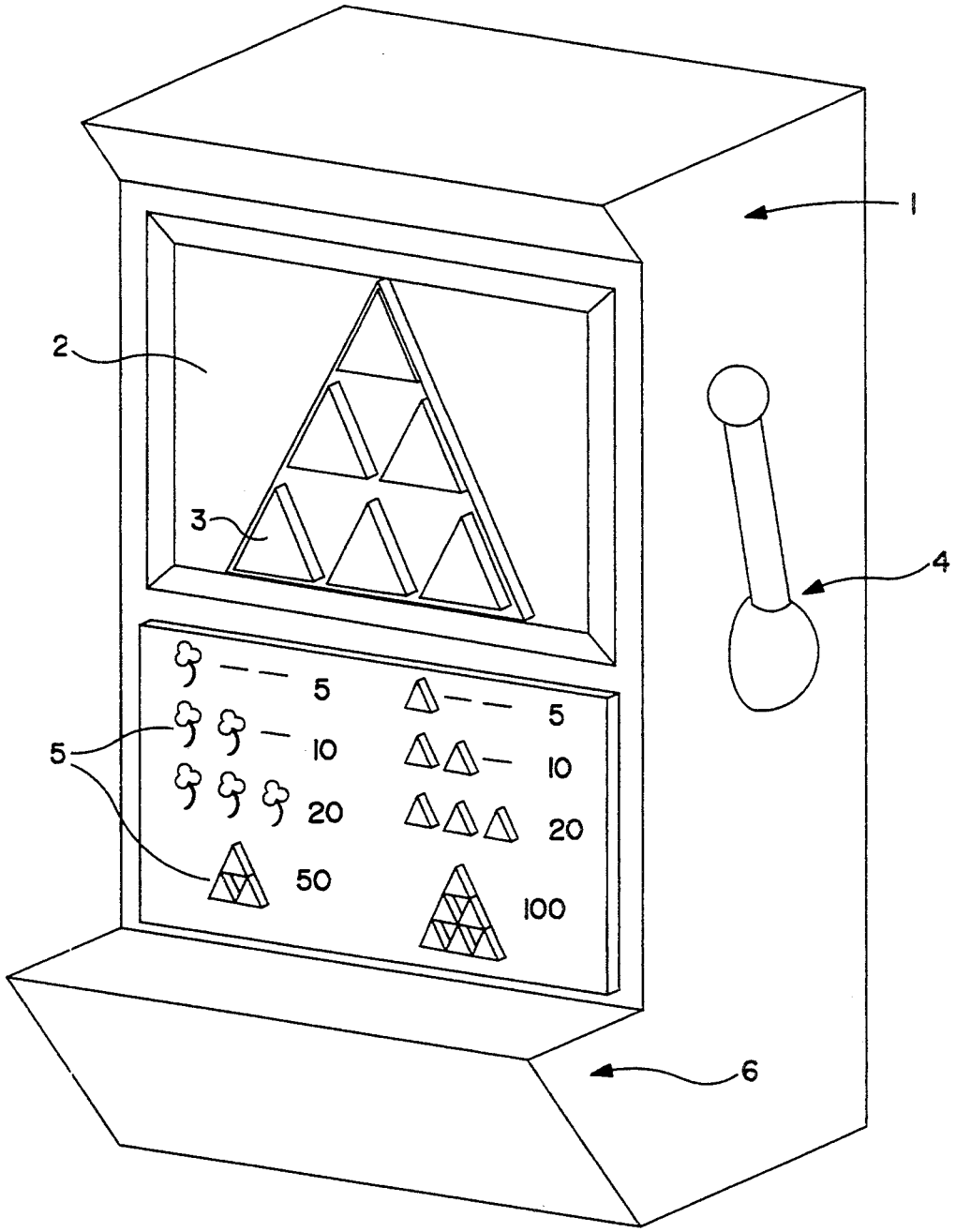
FIG. 1 illustrates a slot machine made in accordance with the invention.

Now referring to the drawings, there is shown different views wherein the same reference characters represent like parts.

FIG. 1 illustrates a slot machine housing 1 having a pyramid window 2 which illustrates the payoff symbols 3 within the pyramid window. A handle 4 for operation of the machine is shown on one side of the housing. The front of the housing illustrates pay off symbols 5 and a drop box 6 for catching any money that is paid out.

Figure 2:
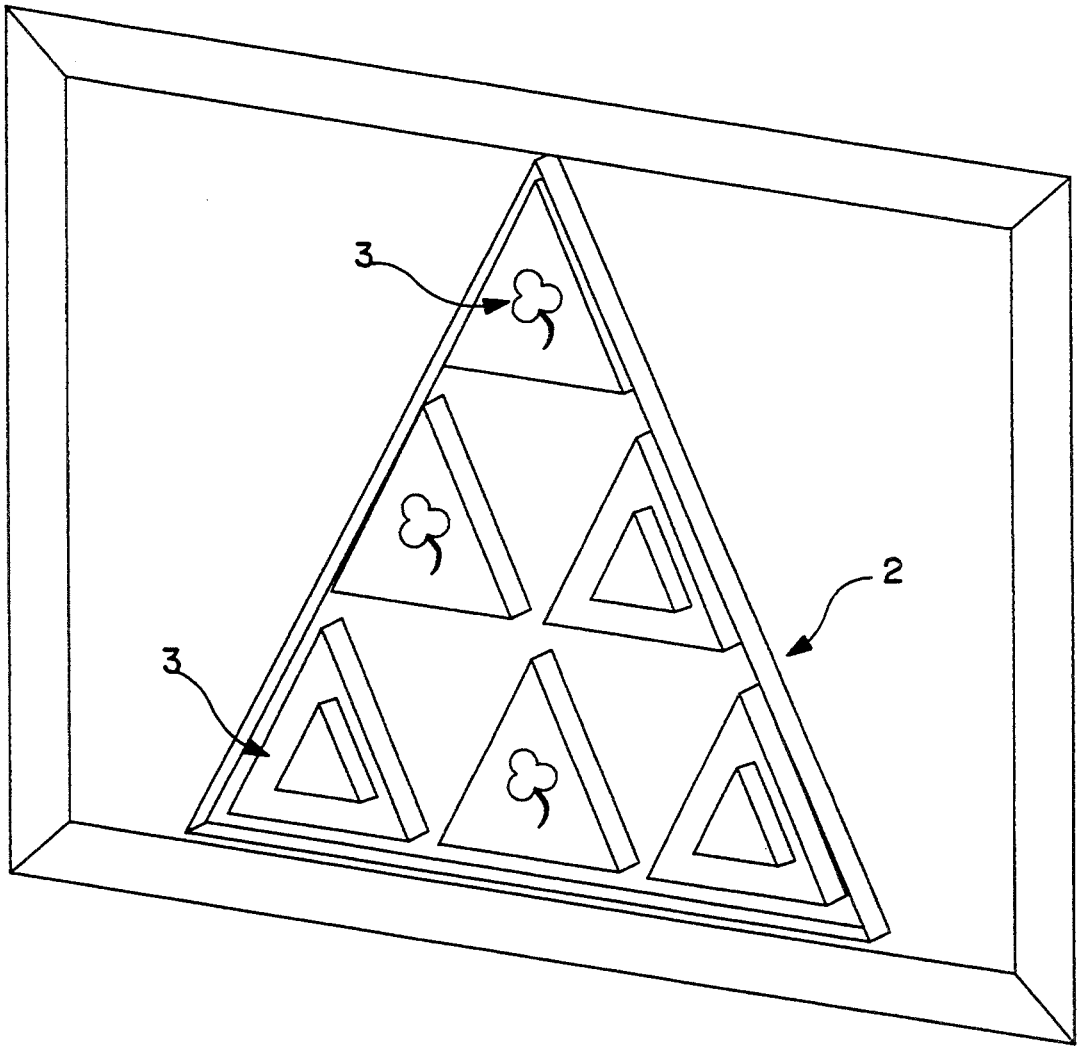
FIG. 2 illustrates a front display of the pyramid play area.
Figure 3:
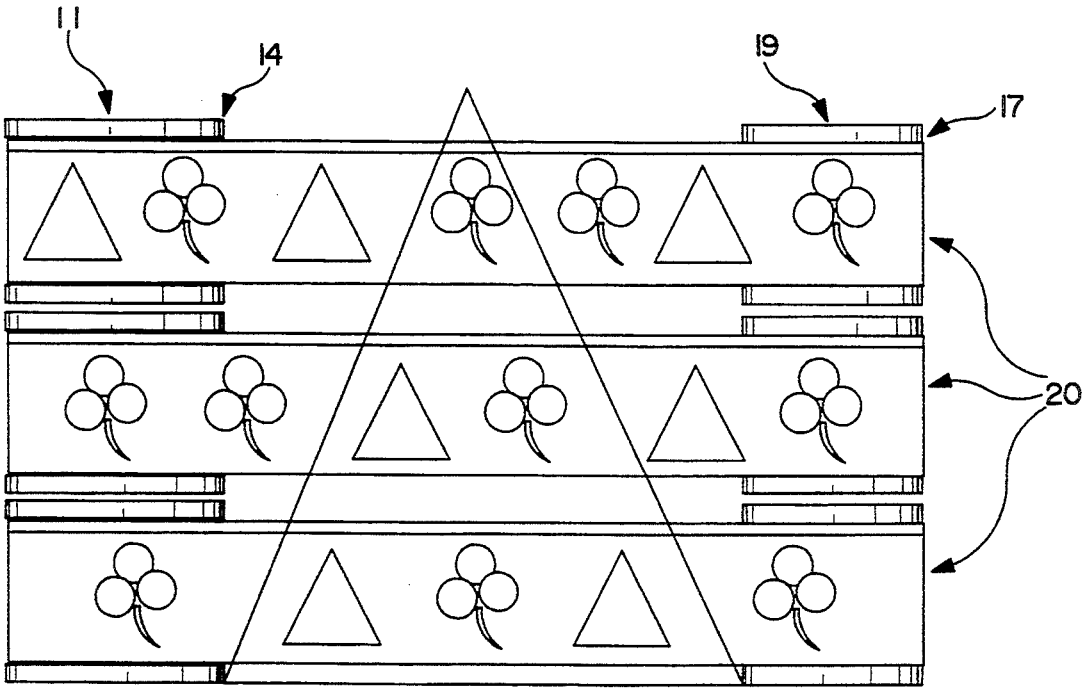
FIG. 3 illustrates the three reels relative to each other and to the pyramid playing area.

FIG. 2 illustrates an enlarged pyramid window 2 with pay symbols 3 showing. FIG. 3 illustrates three parallel belts 20 which are mounted parallel with each other on drums 14 which are mounted by drum mount 11 at one end and at the opposite end of each belt is mounted separate stepping motors 17 which are mounted by motor mounts 19 which are shown more clearly in FIGS. 6–8.

FIG. 4 which includes FIGS. 4*a*–4*f* illustrate different pay off arrangements of the pyramid slot machine which illustrates combinations of three small pyramids which illustrate a pay off of different configurations. The front of the housing illustrate different symbols for payoff.

Figure 5:
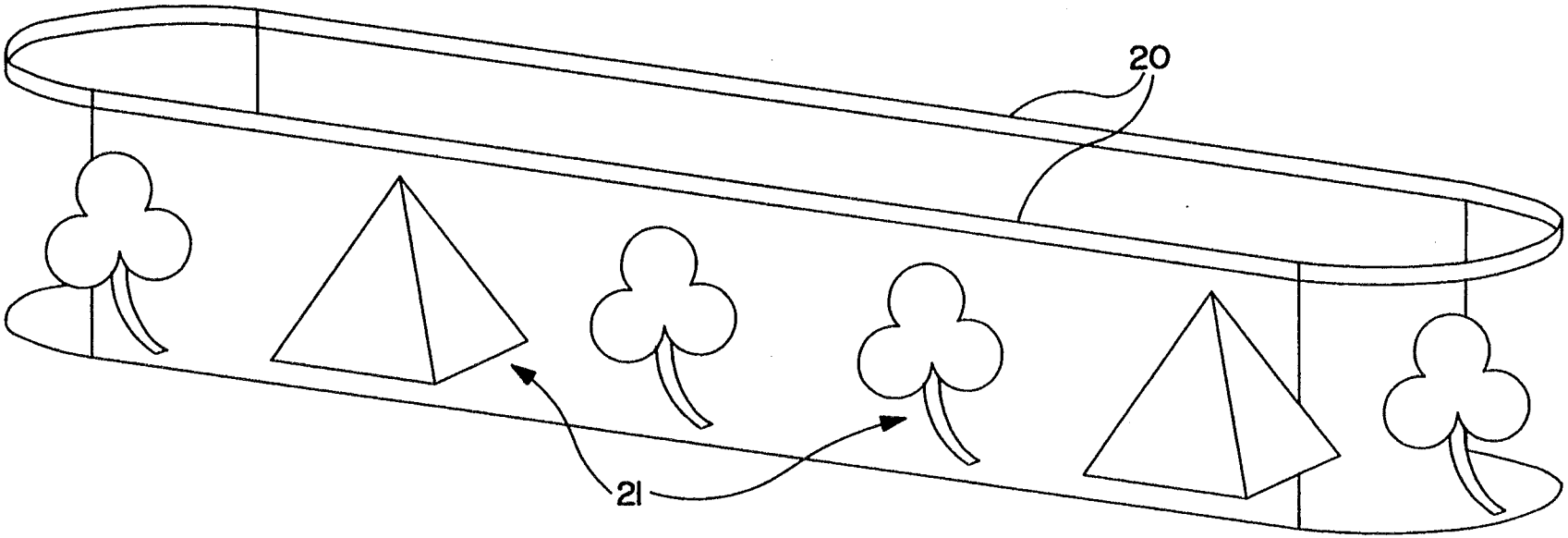
FIG. 5 illustrates a single belt which has the payoff symbols therein.

FIG. 5 is an inlay of one belt 20 which illustrates some symbols 21 thereon, the symbols can be any design desired within a payoff scheme.

Figure 6:
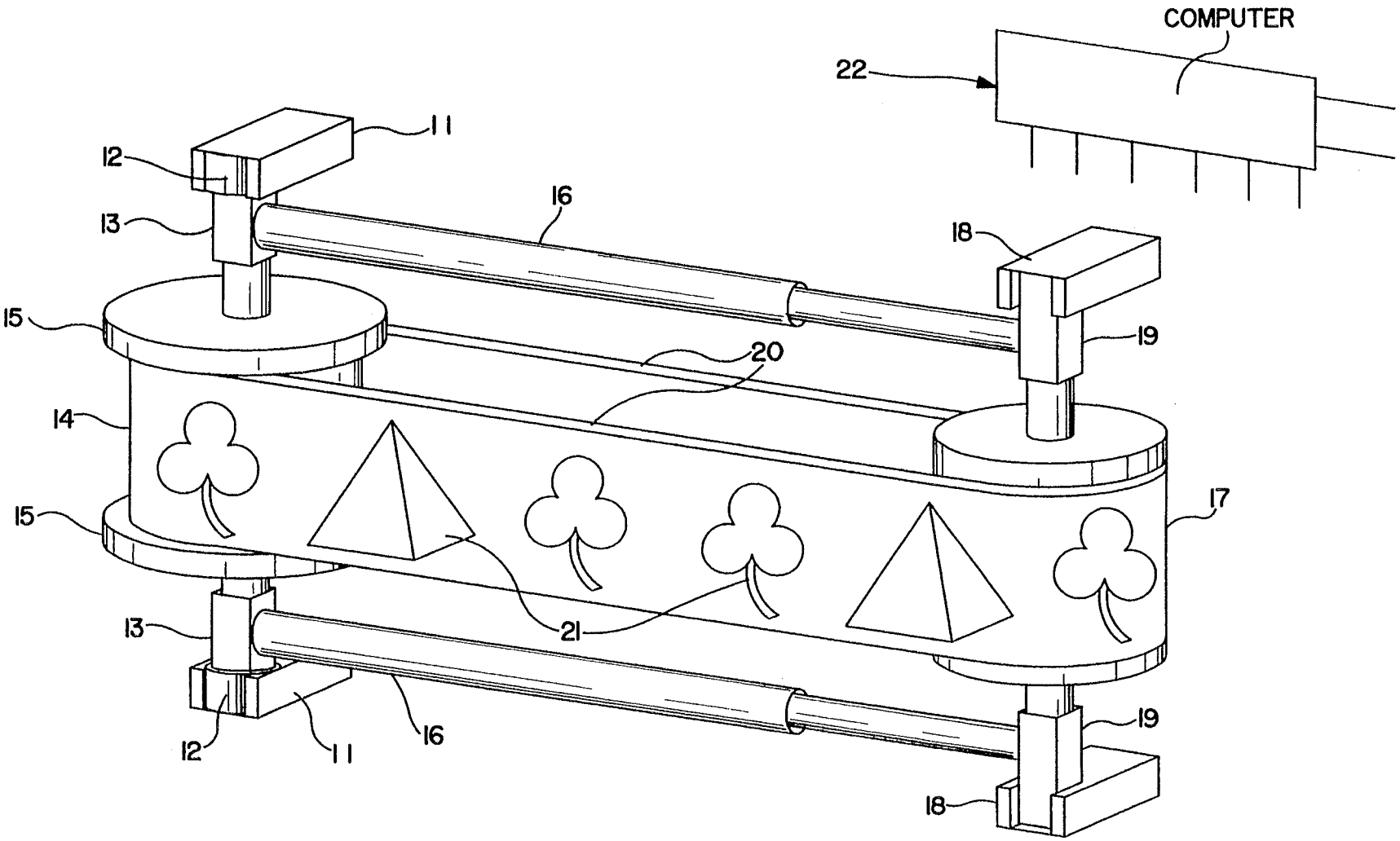
FIG. 6 illustrates one reel which is mounted for rotation by a stepping motor.
Figure 8:
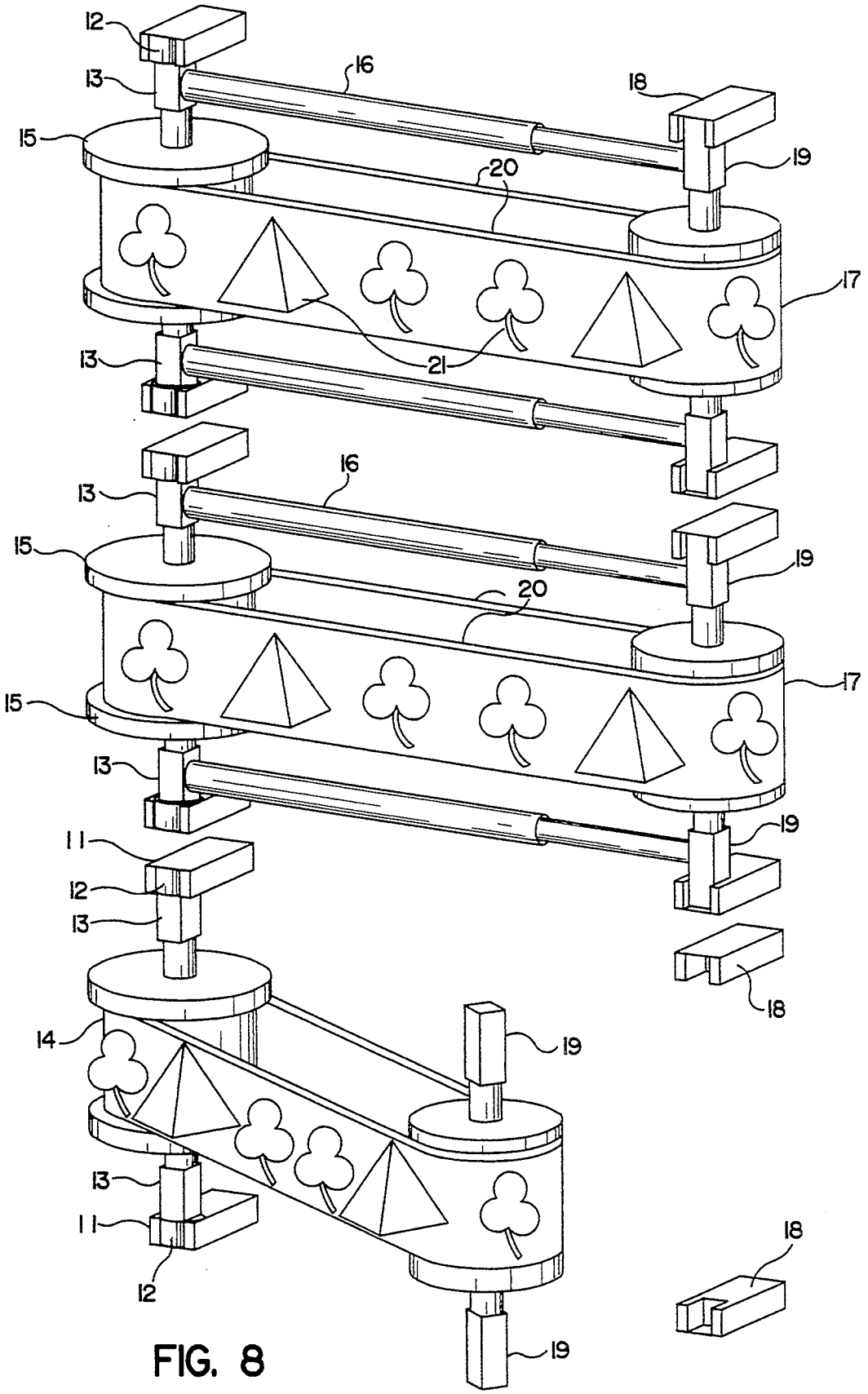
FIG. 8 illustrates two reels mounted in place with one reel swinging outward for removal of the one reel.

FIG. 6 illustrates in more detail an assembled reel support shaft stepping motor and support for the stepping motor and FIG. 8 illustrates removal of a belt and stepping motor and reel mechanism.

Figure 7:
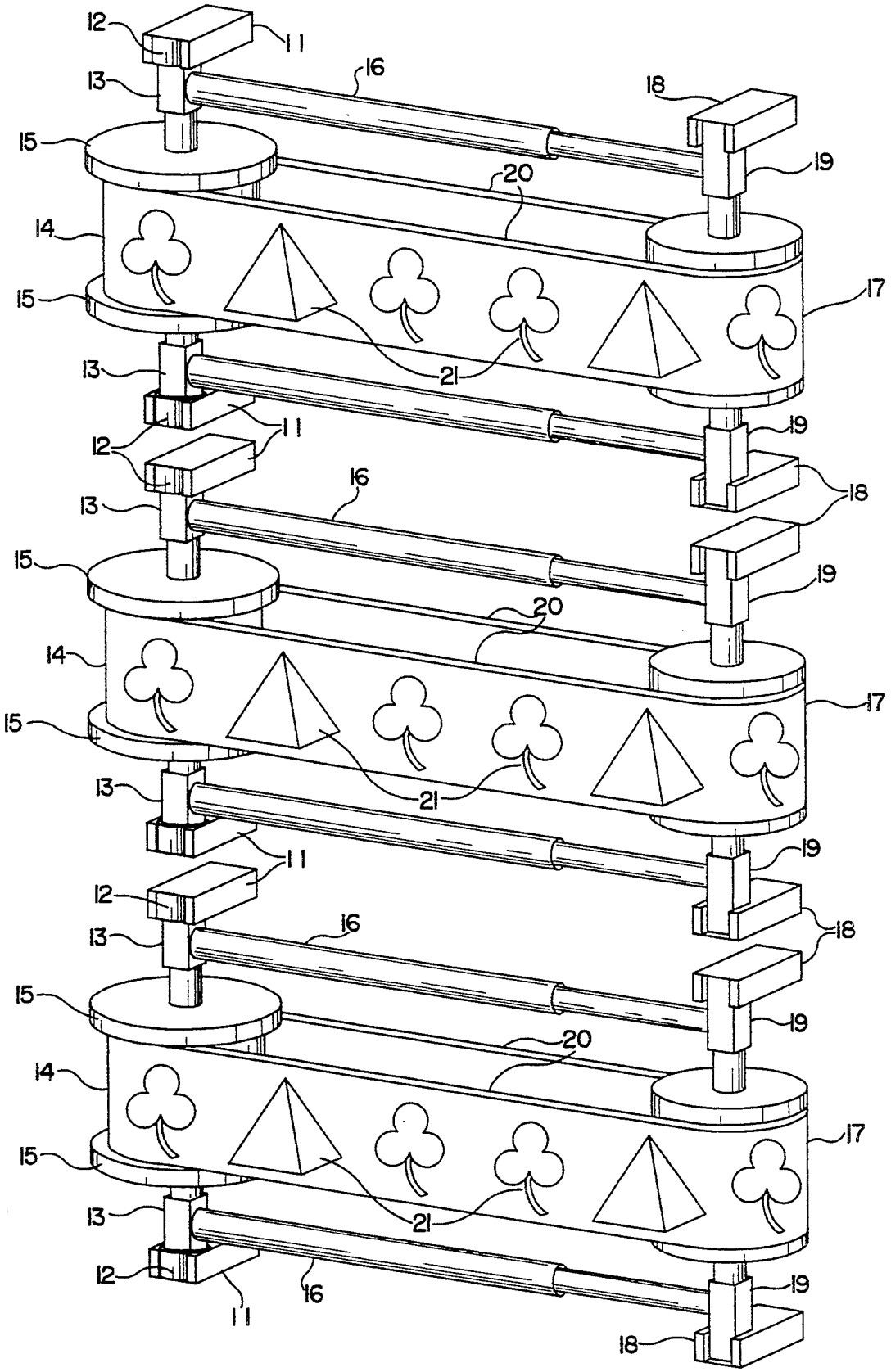
FIG. 7 illustrates the three reels mounted relative to each other with swivel locks at one end and latches at the opposite end for holding the reels in place.

As shown in FIG. 7 the slot machine includes three horizontal parallel reels each of which includes symbols thereon. Each reel is supported at their ends on a separate shaft by a drum so that they will be driven separately and which can be removed independent of each other. Each reel is driven by an inverted stepper motor mounted on motor mounts 19 so that the outside of the motor rotates while the motor shaft is stationary. The inverted stepper motor 17 will be controlled by a computer 22 in the slot machine to start and stop a reel at random selected times. The inverted stepper motor 17 will have fitted around the outside, a layer of course rubber to insure the spinning rotation of the reel tape 20. The motor mounts 19 will be directly connected to one end of the spring rods 16 each of which apply a spring force action to force the reel drum 14 and the stepping motor apart and on the other end of the spring rods a drum mount 13 which holds the mounted drum reel 14 in place. The drum mounts 13 will be attached to a free revolving reel drum 14 which outside rotates and the shaft will be stationary. The reel drum 14 is used as the other end of the reel mechanism, and will also keep the reel tape 20 in place by the tape guides 15. The spring rods 16 are used to apply an outward pressure to keep the reel tape 20 tightly wrapped around the stepper motor 17 and the reel drum 14. Also connected to the drum mounts 13 are swivel locks 12. The swivel locks 12 are incorporated into the reel mount 11. The swivel locks 12 have an opening at one end so the drum mounts 13 can interconnect into them and be removed from the swivel locks when the stepping motor is removed and rotated outwardly sufficiently to release the reel supports from the swivel locks.

To repair or remove the reel mechanism, the following is involved. Pull forward on stepper motor mounts 19 which will release from the reel mount 18 and will rotate in a clockwise direction. When the reel mechanism rotates, this will in turn rotate the swivel locks 12 which hold in place the drum mounts 13. The reel mechanism will swivel freely due to the free revolving reel drum 14 which will act as a pivoting arm. If the reel mechanism needs to be removed, rotate the mechanism until it is free of the swivel locks 12 and pull out the reel mechanism.

The reel tape 20 is shown in FIG. 5. The reel tape 20 is made from an interwoven fabric or a suitable material. To insert the reel tape 20 onto the reel mechanism, a devise will be used, or by hand, to contract the spring rods 16 so that the reel tape 20 can be easily slipped up and over the drum 14 and stepper motor 17. After the reel tape 20 is in place the spring rods 16 can be released so that the reel tape 20 will fit tightly around the drum 14 and between the tape guides 15 and also around the stepper motor 17. On the reel tape 20 itself, display symbols 21 will be imprinted. The symbols 21 will be placed in strategic locations so that a variety of combinations can be displayed. Slot machines today randomly pick what is to be displayed before the motors stop to display the symbols. This means that not all combinations need to be imprinted on the reel tape. The computer tells the stepper motor 17 when to stop and a certain display is shown. Also on the reel tape 20 are symbol identifiers. These identifiers collate with the computer to choose the correct symbols 21 to be displayed.

The way this reel mechanism is designed, any reel can be used in any location of the slot machine. That is, they are all interchangeable with each other. Another aspect of this device is the way each symbol is read. If any slippage occurs to the reel tape during reel spin, the computer can correct the error by telling the stepper motor when to stop and will realign the position of the symbols.

Figure 4A:
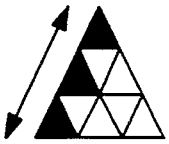
FIG. 4 illustrates FIGS. 4*a*–4*g* which represent different payoff arrangements with the pyramid window.
Figure 4B:
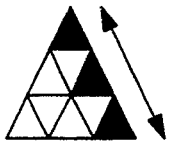
Figure 4C:
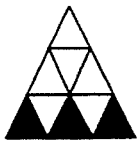
Figure 4D:
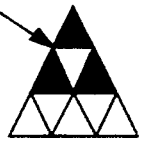
Figure 4E:
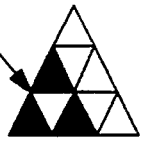
Figure 4F:
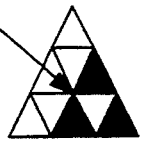
Figure 4G:
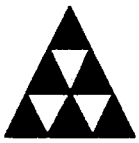

As stated before the pay out sequence will differ from other slot machines. In a three line game the pay out will consist of using the six pyramids, three for each line as shown in FIGS. **4*a*–4*c*. In a buy pay game, a group of three pyramids that are adjacent to each other would be used for the pay out sequence as shown in FIG. 4*d*–4*g*. The LINE PLAY game is, line 1, line 2, or line 3, as in an existing slot machine game. The other version would be the BUY PAY game. One coin would get one pyramid section, two coins would get two pyramid sections, and three coins would get three pyramid sections. If both games were combined, a six way game can be made using three lines and three sections. The jackpot for both games would happen when all the same symbols are shown in all six windows as shown in FIG. 4*g***.

To sum up the concept, this new design can open up a whole new world to slot machine technology. With this slot machine, a company can bring a new dimension in slot play. This will give slot players more variety in their play. As mentioned before it would be easier to reprogram a video game to accommodate the new idea. But for some players, the sight of watching the reels move is part of the excitement of playing a slot machine. Also in another frame of mind, a conversion kit can be built to be installed in existing slot machines. A simple changing of the glass display, the reel mechanism and the ROM's (Read Only Memories), a whole new machine is born.

What is claimed is:

1. A slot machine comprising a plurality of horizontal parallel reels in spaced horizontal planes, each reel having symbols displaying a plurality of symbols on said reels, drive means for driving said reels for rotation in a horizontal plane and control means for stopping said reels at specific stopping points to illustrate specific symbols on said reels, a triangular display window for showing said symbols in a triangular form with an apex of the triangle along a vertical axis.

2. A slot machine as set forth in claim 1, in which there are three parallel reels.

3. A slot machine as set forth in claim 2, in which each reel includes a reel tape that surrounds a driven drum rotatable on a stationary shaft having a first vertical axis, and a stepping motor having a second vertical axis and that said stepping motor drives said driven drum upon which said reel tape is driven in said horizontal plane about said first vertical axis.

4. A slot machine as set forth in claim 3, in which there are first, second and third reels parallel with each other and rotatable in parallel planes, said first reel displays one symbol in said triangular display, said second reel displays two symbols within said triangle, and said third reel displays three symbols within said triangle whereby said symbols are in separate parallel planes and represent a winner or a loser.

5. A slot machine as set forth in claim 4, which includes swivel locks (12) which secure each driven drum in place and latches which lock each of said stepping motors in place and which are swiveled outwardly in order to remove any one of said stepping motors and reel drum from the machine.

6. A slot machine as set forth in claim 2, in which each reel includes a reel tape that surrounds a driven drum rotatable on a stationary shaft having a first vertical axis, and a stepping motor having a second vertical axis and that said stepping motor drives said driven drum upon which said reel tape is driven in said horizontal plane about said first vertical axis.

7. A slot machine as set forth in claim 6, which includes swivel locks (12) which secure each driven drum in place and latches which lock each of said stepping motors in place and which are swiveled outwardly in order to remove any one of said stepping motors and reel drum from the machine.

8. A slot machine as set forth in claim 2, in which there are first, second and third reels parallel with each other and rotatable in parallel planes, said first reel displays one symbol in said triangular display, said second reel displays two symbols in said triangular display, and said third reel displays three symbols within said triangle, whereby said symbols represent a winner or a loser.

9. A slot machine as set forth in claim 8, which includes swivel locks (12) which secure each driven drum in place and latches which lock each of said stepping motors in place and which are swiveled outwardly in order to remove any one of said stepping motors and reel drum from the machine.

10. A slot machine as set forth in claim 1, in which each reel includes a reel tape that surrounds a driven drum rotatable on a stationary shaft having a first vertical axis, and a stepping motor having a second vertical axis and that said stepping motor drives said driven drum upon which said reel tape is driven in said horizontal plane about said first vertical axis.

11. A slot machine as set forth in claim 10, in which there are first, second and third reels parallel with each other and rotatable in parallel planes, said first reel displays one symbol in said triangular display, said second reel displays two symbols in said triangular display, and said third reel displays three symbols within said triangle, whereby said symbols represent a winner or a loser.

12. A slot machine as set forth in claim 11, which includes swivel locks (12) which secure each driven drum in place and latches which lock each of said stepping motors in place and which are swiveled outwardly in order to remove any one of said stepping motors and reel drum from the machine.

13. A slot machine as set forth in claim 1, in which there are first, second and third reels parallel with each other and rotatable in parallel planes, said first reel displays one symbol in said triangular display, said second reel displays two symbols in said triangular display, and said third reel displays three symbols within said triangle, whereby said symbols represent a winner or a loser.

14. A slot machine as set forth in claim 13, which includes swivel locks (12) which secure each driven drum in place and latches which lock each of said stepping motors in place and which are swiveled outwardly in order to remove any one of said stepping motors and reel drum from the machine.

15. A slot machine comprising a plurality of horizontal parallel reels in spaced horizontal planes, each reel having symbols displaying a plurality of symbols on said reels, drive means for driving said reels for rotation in a horizontal plane and control means for stopping said reels at specific stopping points to illustrate specific symbols on said reels, a triangular display window for showing said symbols in a triangular form with an apex of the triangle along a vertical axis and each reel includes a reel tape that surrounds a driven drum rotatable on a stationary shaft having a first vertical axis, and a stepping motor having a second vertical axis and that said stepping motor drives said driven drum upon which said reel tape is driven in said horizontal plane about said first vertical axis.

16. A slot machine as set forth in claim 15, which includes swivel locks (12) which secure each driven drum in place and latches which lock each of said stepping motors in place and which are swiveled outwardly in order to remove any one of said stepping motors and reel drum from the machine.

* * * * *